US008623799B2

(12) United States Patent
Mayhew et al.

(10) Patent No.: US 8,623,799 B2
(45) Date of Patent: Jan. 7, 2014

(54) MARINE DIESEL CYLINDER LUBRICANT

(75) Inventors: Alexandra Mayhew, Wirksworth (GB); Stephen J. Cook, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 289 days.

(21) Appl. No.: 12/996,777

(22) PCT Filed: Jul. 6, 2009

(86) PCT No.: PCT/US2009/049664

§ 371 (c)(1),
(2), (4) Date: Jan. 26, 2011

(87) PCT Pub. No.: WO2010/005884

PCT Pub. Date: Jan. 14, 2010

(65) Prior Publication Data

US 2011/0120403 A1 May 26, 2011

Related U.S. Application Data

(60) Provisional application No. 61/078,795, filed on Jul. 8, 2008.

(51) Int. Cl.
*C10M 159/22* (2006.01)
*C10M 159/24* (2006.01)

(52) U.S. Cl.
USPC ..... 508/574; 508/391

(58) Field of Classification Search
USPC ..... 508/391, 574
See application file for complete search history.

(56) References Cited

U.S. PATENT DOCUMENTS 4,131,433 A 12/1978 Scott
5,169,785 A * 12/1992 Altman et al. ..... 436/60
5,202,036 A * 4/1993 Ripple et al. ..... 508/192
5,688,751 A 11/1997 Cleveland et al.
5,804,537 A * 9/1998 Boffa et al. ..... 508/398
2002/0128160 A1 * 9/2002 Dunn et al. ..... 508/482
2004/0118032 A1 6/2004 Aradi et al.
2005/0209110 A1 * 9/2005 Roski et al. ..... 508/192

FOREIGN PATENT DOCUMENTS

WO 89/08803 9/1989
WO 02099016 12/2002
WO 2005042678 5/2005
WO 2007047447 4/2007

OTHER PUBLICATIONS

Cherng-Huan Lin; "Influence of vanadium compounds on burning characteristics of emulsified marine fuel oil C"; Ocean Engineering, vol. 27, 2000, pp. 589-601.
"Magnesium as a Solution for the Corrosion Problems Derived from the Combustion of Heavy Fuel Oil", Apr. 2002, www.rbbertomeu.es/htmlish/indexish.htm, "technical documentation".

* cited by examiner

*Primary Examiner* — Jim Goloboy
(74) *Attorney, Agent, or Firm* — David M. Shold; Michael F. Esposito

(57) ABSTRACT

A marine diesel cylinder is lubricated using a lubricant having a total base number (TBN) of at least about 25, comprising an oil of lubricating viscosity and a metal-containing detergent component. Forty to 90 percent of the TBN derived from the metal-containing detergent component is provided by calcium detergent; 5 to 40 percent of the TBN by sodium detergent; and 5 to 45 percent by magnesium detergent. At least 50 weight percent of the total detergent substrate is sulfonate and less than 50 weight percent is monomeric or oligomeric substrate comprising one or more units of alkyl-substituted phenol having an alkyl group of 8 to 14 carbon atoms. The lubricant is useful when the marine diesel engine is fueled with a liquid fuel containing at least 2 ppm vanadium.

13 Claims, No Drawings

MARINE DIESEL CYLINDER LUBRICANT

BACKGROUND OF THE INVENTION

The disclosed technology relates to a lubricant composition with selected detergents suitable for providing reduced deposits when lubricating a marine diesel engine cylinder.

Lubrication of marine diesel engines, and in particular their cylinders, is challenging in part because of the types of fuel consumed by such engines, which may lead to an increased susceptibility to deposit formation compared with other internal combustion engines. Marine diesel cylinder lubricants are used for one pass and are consumed, rather than being retained in a sump. Such lubricants typically require a high detergent level, imparting high levels of basicity as measured by Total Base Number (TBN) to the lubricant, typically resulting in TBN levels of 25 or greater, such as 30 or greater, such as 40 or greater, 50 or greater, or 70 or greater, and typically up to 100 or to 100 or to 80. Often, phenate detergents of various types have been employed, and they have been more or less successful in controlling deposit formation.

However, there has recently been raised concern that phenate detergents may contain certain amounts of objectionable substituted phenols such as paradodecylphenol (PDDP) as byproducts or unreacted starting materials. PDDP has come under attention recently as a possible reprotoxicant, that is, a material that may cause harm to unborn children. Accordingly, there is a desire to reduce the amount of PDDP in lubricant additives, and that is presumed to involve reducing the amount of phenate detergent employed. Reducing the amount of phenate detergent, however, will have detrimental effects on the amount of deposit formation in a marine diesel engine and, absent some solution, would be unacceptable.

Various chemical means are potentially available for reducing deposit formation, but each has its real or perceived drawbacks. Sodium detergents, such as sodium sulfonate detergents, have been examined for their deposit reducing characteristics, but the use of sodium compounds in marine diesel lubricants typically leads to other problems. In particular, fuels for marine diesel engines typically contain a certain amount of vanadium (not normally present in distillate fuels for gasoline or diesel engines), which, in combination with alkali metals such as sodium can, under some circumstances, lead to the formation of metal vanadates which can be responsible for a problem which is known in the industry as "hot corrosion." In a different combustion environment, U.S. Patent Application 2004/0118032, Aradi et al., Jun. 24, 2004, discloses manganese compounds to inhibit both low and high-temperature corrosion in utility and industrial furnace systems. There is discussion in paragraphs 0003, 0004, and 0051 of this document of the mechanisms by which sodium vanadate may form and promote corrosion. The fuel disclosed in Aradi may also contain a catalyst package that may be composed of one or more of Li, Na, K, Mg, Ca, Sr, Ba, Mo, Fe, Co, Pt, or Ce.

U.S. Patent Application Publication 2005/0209110, Roski et al., Sep. 22, 2005, discloses lubricating compositions containing at least 3 weight percent of (a) an overbased sulphonate detergent and at least 1.5 weight percent of (b) a sulphur containing phenate detergent. The composition is suitable for internal combustion engines, particular marine diesel applications to provide improved cleanliness, decreased cylinder wear and reduced deposits. Metals usable in the detergents include an alkali metal such as lithium, sodium or potassium; or an alkaline earth metal such as magnesium, calcium, or barium. There is also disclosure that for detergents in general (in addition to those described as components (a) and (b)), most commonly used metals include sodium, magnesium, calcium or mixtures thereof.

U.S. Pat. No. 5,804,537, Boffa et al., Sep. 8, 1998, discloses a crankcase lubricant, especially a low phosphorus passenger car motor oil, with a tri-metal detergent mixture. The lubricant is characterized by unexpectedly superior engine deposit performance. The tri-metal detergent mixture may comprise at least one calcium overbased metal detergent, at least one magnesium overbased metal detergent and at least one sodium overbased metal detergent. The total TBN contributed to the oil composition by said tri-metal detergent mixture is from about 2 to about 12.

The disclosed technology, therefore, solves the problem of maintaining good deposit control and low corrosion in a marine diesel lubricant, while reducing the amount of phenolic detergent present, by the careful selection and balancing of detergent components.

SUMMARY OF THE INVENTION

The disclosed technology provides a method for lubricating a cylinder of a marine diesel engine, comprising supplying to said cylinder a lubricant having a total base number (TBN) of at least 25, which lubricant comprises an oil of lubricating viscosity and a metal-containing detergent component, which detergent component comprises a multiplicity of detergent species; wherein 40 to 90 percent of the TBN derived from the metal-containing detergent component is provided by one or more calcium detergents; 5 to 40 percent of such TBN is provided by one or more sodium detergents; and 5 to 45 percent of such TBN is provided by one or more magnesium detergents; wherein at least 50 weight percent of the total detergent substrate in the lubricant is sulfonate detergent substrate and less than 50 weight percent of the total detergent substrate in the lubricant a monomeric or oligomeric substrate comprising one or more units of alkyl-substituted phenol which in turn comprises at least one alkyl group of about 8 to about 14 carbon atoms, and wherein said marine diesel engine is fueled with a liquid fuel which contains at least 2 parts per million by weight vanadium.

The technology further provides a marine diesel engine, fueled with a liquid fuel which contains at least 2 parts per million by weight vanadium, having a cylinder thereof lubricated with a lubricant having a total base number (TBN) of at least 25, which lubricant comprises an oil of lubricating viscosity and a metal-containing detergent component, which detergent component comprises a multiplicity of detergent species; wherein 40 to 90 percent of the TBN derived from the metal-containing detergent component is provided by one or more calcium detergents; 5 to 40 percent of such TBN is provided by one or more sodium detergents; and 5 to 45 percent of such TBN is provided by one or more magnesium detergents; and wherein at least 50 weight percent of the total detergent substrate in the lubricant is sulfonate detergent substrate and less than 50 weight percent of the total detergent substrate in the lubricant is a monomeric or oligomeric substrate comprising one or more units of alkyl-substituted phenol which in turn comprises at least one alkyl group of about 8 to about 14 carbon atoms.

The technology further provides a lubricant suitable for lubricating a cylinder of a marine diesel engine, comprising an oil of lubricating viscosity and a metal-containing detergent component, which detergent component comprises a multiplicity of detergent species, said lubricant having a total base number (TBN) of at least 10 or 12 or 15 or 20 or 25; wherein 40 to 90 percent of the TBN derived from the metal-containing detergent component is provided by one or more calcium detergents; 5 to 40 percent of such TBN is provided by one or more sodium detergents; and 5 to 45 percent of such TBN is provided by one or more magnesium detergents; and wherein at least 50 weight percent of the total detergent substrate in the lubricant is sulfonate detergent substrate and less than 50 weight percent of the total detergent substrate in the lubricant is a monomeric or oligomeric substrate comprising one or more units of alkyl-substituted phenol which in turn comprises at least one alkyl group of about 8 to about 14 carbon atoms. In one embodiment the lubricant further comprises vanadium as a result of interaction with a vanadium-containing fuel within an engine

DETAILED DESCRIPTION OF THE INVENTION

Various preferred features and embodiments will be described below by way of non-limiting illustration.

The base oil used in the inventive lubricating oil composition may be selected from any of the base oils in Groups I-V as specified in the American Petroleum Institute (API) Base Oil Interchangeability Guidelines, e.g., Group I (>0.03% S and/or <90% saturates, viscosity index 80-120) or Group II (≤0.03% S and ≥90% saturates, viscosity index 80-120). Higher viscosity index oils may also be used. The oil of lubricating viscosity, then, can include natural or synthetic lubricating oils and mixtures thereof. Mixture of mineral oil and synthetic oils such as polyalphaolefin oils and polyester oils may be used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity. Oils of lubricating viscosity derived from coal or shale are also useful.

Hydrotreated naphthenic oils are also known and can be used. Synthetic oils may be used, such as those produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The present lubricant compositions also contain a metal-containing detergent component. Detergents are salts, and they are often overbased salts. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base, and a promoter such as a phenol or alcohol.

The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Such overbased materials are well known to those skilled in the art. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Overbased saligenin detergents are commonly overbased magnesium salts which are based on saligenin derivatives. A general example of such a saligenin derivative can be represented by the formula

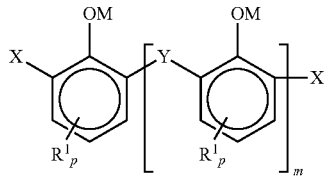

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion (that is to say, in the case of a multivalent metal ion, one of the valences is satisfied by the illustrated structure and other valences are satisfied by other species such as anions, or by another instance of the same structure), $R^1$ is a hydrocarbyl group containing 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. It is well known that minor variations can occur in the above formula and in other formulas used in this document, including in particular positional isomerization, that is, location of the X, Y, and R groups at different position on the aromatic ring from those shown in the structure. The expression "represented by the formula" as used throughout this document is expressly intended to encompass such variations. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a substantially linear compound comprising at least one unit of formula (I) or formula (II):

(I)

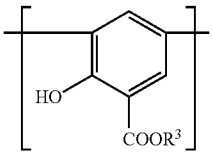

(II)

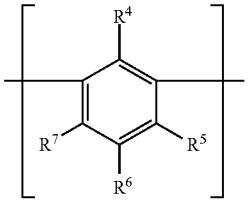

each end of the compound having a terminal group of formula (III) or (IV):

(III)

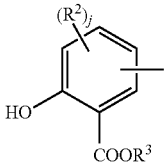

(IV)

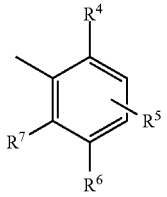

such groups being linked by divalent bridging groups A, which may be the same or different for each linkage; wherein in formulas (I)-(IV) $R^3$ is hydrogen or a hydrocarbyl group; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is about 0.1:1 to about 2:1. The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin). Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

The lubricant composition will have a total base number ("TBN," ASTM D 2896) of at least 25 or at least 30, e.g., 25-110, 25-100, 30-100, 40-80, 30-75, or 40-70. Most of the basicity of the lubricant composition may be contributed by the detergent component, although typically a relatively small amount (e.g., less than 5%) of the TBN is contributed by other species such as nitrogen-containing dispersants (described below). In the present lubricants, a large portion of the TBN which is contributed by the detergent component is provided by one or more calcium detergents, and in one embodiment one or more calcium overbased detergents. Thus, 40 to 90 percent of the detergent TBN may be from one or more calcium detergents, or 50 to 90 percent or 55 to 85 percent or 60 to 80 percent or 60 to 75 percent.

A relatively minor amount of the detergent TBN may be provided by one or more sodium detergents, namely, 5 to 40 percent, or 6 to 30 percent or 10 to 20 percent or 11 to 15 percent. Similarly, a relatively minor amount of the TBN may be provided by one or more magnesium detergents, namely, 5 to 45 percent, or 10 to 35 percent or 15 to 30 percent. In some embodiments the amount of magnesium present in the lubricant may approximately equal to the amount of sodium, on a weight basis, represented by weight ratios of 0.5:1 to 2:1 Mg:Na, or ratios of 0.5:1 to 1.8:1 or 0.7:1 to 1.5:1 or 0.8:1 to 1.25:1.

In the lubricants used herein, a significant portion (e.g., at least 35 percent by weight, or 35 to 98 percent or 40 to 95 percent, or 50 to 90 percent of the total detergent substrate will be sulfonate detergent substrate and less than 65 weight percent will be a monomeric or oligomeric substrate comprising one or more units of alkyl-substituted phenol which in turn comprises at least one alkyl group of 8 to 14 carbon atoms. By "detergent substrate" is meant the anionic portion of the detergent, that is, excluding metal ions and metal carbonate that is typically used in preparing an overbased salt. (Diluent oil is also excluded from the calculation; it is excluded from all amounts of components as reported in this document, except as specifically noted.) Thus, a sulfonate detergent substrate may be described as a sulfonic acid.

The sulfonic acids useful as substrates for making sulfonate detergents include sulfonic and thiosulfonic acids. Sulfonic acids include mono- and poly-nuclear aromatic and cycloaliphatic compounds. Oil-soluble sulfonic acids can be represented for the most part by one of the following formulas: $R^2$-T-$(SO_3H)_a$ and $R^3$—$(SO_3H)_b$, wherein T is a cyclic nucleus and may be an aromatic nucleus, such as benzene, naphthalene, anthracene, diphenylene oxide, diphenylene sulfide, or petroleum naphthenes; $R^2$ is an aliphatic group such as alkyl, alkenyl, alkoxy, or alkoxyalkyl; $(R^2)$+T may contain a total of at least 15 carbon atoms or at least 20 or 30 or 50 carbon atoms, and up to 200 or 150 or 100 or 50 carbon atoms; in certain embodiments, 60 to 80 carbon atoms; and $R^3$ is an aliphatic hydrocarbyl group which may likewise contain at least 15 or at least 20 or 30 or 50 carbon atoms, and up to 200 or 150 or 100 or 50 carbon atoms. Examples of $R^3$ are alkyl, alkenyl, alkoxyalkyl, and carboalkoxyalkyl groups. The groups T, $R^2$, and $R^3$ in the above formulas can also contain other inorganic or organic substituents in addition to those enumerated above such as, for example, hydroxy, mercapto, halogen, nitro, amino, nitroso, sulfide, and disulfide. In the above formulas, a and b are independently at least 1, and they may be a number up to the number of available positions of attachment on T or on $R^3$. In some embodiments a and b may be 1 to 5, or 1 to 3, or 1, or 2. There may be, furthermore, multiple $R^2$ groups of various types as described attached to the T group. In one embodiment the sulfonate detergent may be a predominantly linear alkylbenzertesulfonate detergent as described in paragraphs [0026] to [0037] of US Patent Application 2005-065045. Alternatively, the sulfonate detergent may comprise a branched alkyl group or a mixture of branched and linear alkyl groups. The sulfonate detergent may be overbased or not overbased; if overbased, it may be a relatively high TBN material (e.g., TBN 200-500, oil-containing basis) and/or a relatively low TBN material (e.g, TBN 20-200, oil-containing). The sulfonate may similarly have a high metal ratio (at least 8) or a lower metal ratio (less than 8). In one embodiment the sulfonate detergent is an overbased carbonated calcium sulfonate having a TBN of 200-500 (e.g., 400, being reported on the oil-containing material, containing 40-45% oil and 55-60% active chemical) based on a sulfonate with one linear alkyl group of 800-1500 Mn (about 1000 Mn) polyisobutene.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Less than 50 weight percent of the total detergent substrate in the lubricant is a particular class of phenate substrate as described below. Although it is not required that any of the particular phenate substrate be present, in certain embodiments they may be desirable, in comparatively low amounts for the deposit protection they may provide. Thus, their amounts may be 0 to less than 50 percent of the total detergent substrate, or 1 to 50 percent, or 1 to 45 percent, or 5 to 45 percent, or 10 to 40, or 15 to 35, or 25 to 35 percent. In one embodiment these numbers apply to the particular phenate substrates described below; in another they may apply to all the phenate-based substrates. In one embodiment, the amount of the sulfonate detergent substrate may be equal to 100% less the amount of the phenate substrates, and in another embodiment it may be less than that amount, such that other detergent types or substrates may also be present.

In one embodiment, the particular phenate substrate which is referred to is a monomeric or oligomeric substrate comprising one or more units of alkyl-substituted phenol which in turn comprises at least one alkyl group of about 8 to about 14 carbon atoms, or 10 to 14 carbon atoms, or 12 carbon atoms.

In certain embodiments the phenate substrate is an alkylphenol sulfide substrate. An alkylphenol sulfide is an alkyl-substituted phenol which has been reacted with sulfur or a reactive equivalent thereof, which provides sulfur links or bridges between the aromatic rings of phenol moieties, or which may simply provide sulfur substitution on the aromatic group of the phenol. In certain instances, the alkylphenol sulfide substrate may be represented by the structure

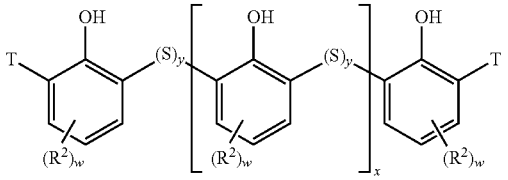

wherein each y is independently 1 to 8; each $R^2$ is independently an alkyl group; each w is independently 0 to 3, provided that at least one aromatic ring contains an $R^2$ substituent containing 8 to 14 carbon atoms; each T is independently hydrogen or an $(S)_y$ linkage terminating in hydrogen or a non-phenolic hydrocarbyl group; and x is 0 to 10.

Other alkyl-phenol containing detergents, that is, detergents derived from a substrate that may contain an alkyl phenol component, may include salixarate detergents and saligenin detergents, as described above. These materials may be of interest because, like the sulfurized phenate detergents, they may contain a certain amount of monomeric alkylphenol substrate, and if the length of the alkyl group is within the indicated ranges (e.g., 8 to 14 carbon atoms), it may also be undesirable to have large amounts of these materials present. Therefore, the amounts of the substrates of these detergents may optionally be included within the relative and absolute amounts of phenate detergents set forth herein.

The overall amounts of the complete detergents, including metal, substrate, and carbonate, will of course vary with the amount and extent of overbasing of the detergent. In certain embodiments, however, the calcium sulfonate detergent may comprise 4 to 10 percent by weight of the lubricant, or 4.5 to 8.5 percent, or 5 to 7 percent (oil free basis). Similarly, the amount of the alkyl-substituted phenate detergent may be less than 3 percent by weight, such as 0.5 to 2.5 or 1 to 2 percent by weight.

In certain embodiments, the lubricant may comprise 0.3 to 1.4 or 0.6 to 1.4 weight percent of an overbased sodium sulfonate detergent and 1.1 to 3.5 weight percent of an overbased magnesium sulfonate detergent. In other embodiments, the lubricant may comprise 1 to 2 percent by weight calcium alkyphenate detergent, 4 to 10 percent by weight calcium sulfonate detergent, 1 to 2 percent by weight sodium sulfonate detergent, and 1.5 to 3 percent by weight magnesium sulfonate detergent.

The lubricants as described herein are particularly suitable for use in marine diesel engines which are fueled with liquid fuels that contain a small amount of vanadium, such as at least 2 parts per million or at least 5 or 10 parts per million. The upper limit on the amount of vanadium present in the fuel is not particularly critical, although in severe cases the amount of vanadium may be up to 600 parts per million by weight. In other instances fuels will contain up to 300 or 100 or 50 or 20 parts per million vanadium. As mentioned above, vanadium can be a significant contaminant when used in connection with sodium detergents, because in the presence of combustion processes and gases, sodium vanadate may be formed, which may lead to corrosion problems. The present invention specifies that at least a certain minimum amount of magnesium is present to ameliorate the problem.

The lubricant used in the present invention may also contain a dispersant. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

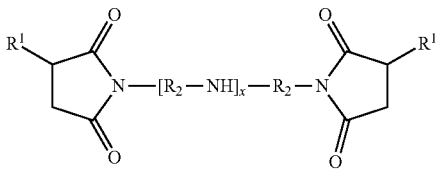

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

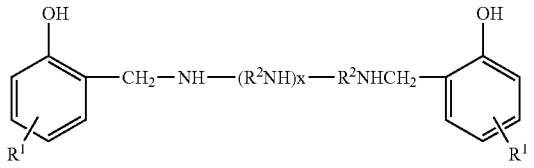

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer. Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatments are listed in U.S. Pat. No. 4,654,403.

The amount of dispersant present in the lubricant may be 0.1 to 6 percent by weight, for instance, 0.2 to 4 or 0.3 to 2 or 0.4 to 1 percent.

Other conventional additives may also be present in the lubricants described herein, especially those additives that have been used in marine diesel cylinder lubricants. Among known lubricant additives are metal salts of a phosphorus acid, including metal compounds represented by the formula

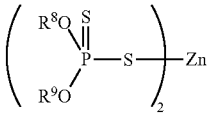

The $R^8$ and $R^9$ groups are independently hydrocarbyl groups that are typically free from acetylenic and usually also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohol which reacts to provide the $R^8$ and $R^9$ groups can be a mixture of a secondary alcohol and a primary alcohol, for instance, a mixture of 2-ethylhexanol and 2-propanol or, alternatively, a mixture of secondary alcohols such as 2-propanol and 4-methyl-2-pentanol. Such materials are often referred to as zinc dialkyldithiophosphates or simply zinc dithiophosphates. They are well known and readily available to those skilled in the art of lubricant formulation. The amount of the metal salt of a phosphorus acid in a completely formulated lubricant, if present, may be 0.1 to 4 percent by weight, 0.5 to 2 percent by weight, or 0.75 to 1.25 percent by weight.

Other lubricant additive components may also be included in the present lubricants. Such materials include viscosity modifiers, which may be included, although many marine diesel cylinder lubricants do not include them. Viscosity modifiers generally are polymeric materials characterized as being hydrocarbon-based polymers generally having number average molecular weights between 25,000 and 500,000, e.g., between 50,000 and 200,000. They may include homopolymers and copolymers of two or more monomers of C2 to C30, e.g., C2 to C8 olefins, such as ethylene-propylene copolymers, hydrogenated styreneconjugated diene copolymers, and polymethacrylates (PMA). A small amount of a nitrogen-containing monomer may be incorporated in the polymer to provide multiple functionality including viscosity modification, pour point depressancy and dispersancy.

Another additive which may be present is an antioxidant. Antioxidants encompass phenolic antioxidants, which may comprise a butyl substituted phenol containing 2 or 3 t-butyl groups, especially t-butyl groups. The para position of the phenol may also be occupied by a hydrocarbyl group or a group bridging two aromatic rings. In certain embodiments the para position is occupied by an ester-containing group, such as, for example, an antioxidant of the formula

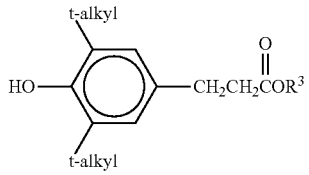

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines, such as an alkylated diphenylamine such as nonylated diphenylamine, including a mixture of a dinonylated amine and a monononylated amine.

Antioxidants also include sulfurized olefins such as mono-, or disulfides or mixtures thereof. These materials generally have sulfide linkages having 1 to 10 sulfur atoms, for instance, 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents. The use of molybdenum and sulfur containing compositions in lubricating oil compositions as antiwear agents and antioxidants is known. U.S. Pat. No. 4,285,822, for instance, discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition.

Typical amounts of antioxidants will, of course, depend on the specific antioxidant and its individual effectiveness, but illustrative total amounts can be 0.01 to 5 percent by weight or 0.15 to 4.5 percent or 0.2 to 4 percent.

Other conventional components may also be present, including pour point depressants; friction modifiers such as fatty esters; metal deactivators; rust inhibitors, high pressure additives, anti-wear additives, and antifoam agents. In one embodiment a rust inhibitor such as a hydroxy-containing ether or a tartrate or citrate ester may be present in an amount of 0.02 to 2 percent by weight. Tartaric acid derivatives may also be effective as one or more of antiwear agents, friction modifiers, antioxidants, and agents for improved seal performance.

The role of a corrosion inhibitor is to preferentially adsorb onto metal surfaces to provide protective film, or to neutralize corrosive acids. Examples of these include, but are not limited to ethoxylates, alkenyl succinic half ester acids, zinc dithiophosphates, metal phenolates, basic metal sulfonates, fatty acids and amines.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

Pour point depressants are used to improve the low temperature properties of oil-based compositions. See, for example, page 8 of "Lubricant Additives" by C. V. Smalheer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants are described in U.S. Pat. No. 3,250,715.

Titanium compounds including soluble titanium-containing materials such as titanium isopropoxide, ethylhexyl titanate, and titanium-containing dispersants may also be used to impart an of a variety of beneficial properties such as deposit control, oxidation control, and improved filterability. Some such titanium materials are disclosed in greater detail in US patent publication 2006-0217271, Sep. 28, 2006.

Any one or more of the optional components can be present or can be eliminated, if desired.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character.

Examples of hydrocarbyl groups include:

hydrocarbon substituents, that is, aliphatic (e.g., alkyl or alkenyl), alicyclic (e.g., cyclo alkyl, cyclo alkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

A series of formulations are prepared in an SAE 50 grade lubricant base oil comprising a 72:28 weight mixture of Esso 600 N oil and 150 N brightstock. Each formulation also contained calcium, sodium, and magnesium detergents (sulfonates and C-12 alkylphenol sulfide) in the amounts indicated in the table below, in weight percent. The amount of para-dodecylphenol in each formulation, by analysis of the phenate component, is also reported in weight percent. Each formulation is subjected to the Panel Coker test, which involves placing the test sample in a 250 mL Panel Coker apparatus and heating to 325° C. The sample is splashed against a metal plate for 15 seconds and then baked for 45 seconds. The splashing and baking cycle is continued for approximately 3 hours. The sample is cooled to room temperature and the amount of deposits left on the metal plate is weighed. Results are presented in the table in terms of deposit formation in mg and visual rating. The higher visual rating numbers are better.

| | Example | | | | | | | | |
|---|---|---|---|---|---|---|---|---|---|
| | 1* | 2* | 3 | 4 | 5* | 6 | 7 | 8 | 9 |
| Ca alkylphenol sulfide, TBN 145 (incl 27% oil) | 5 | 2 | 2 | 2 | 2 | 2 | 2 | 1 | 0 |

-continued

| | Example | | | | | | | | |
|---|---|---|---|---|---|---|---|---|---|
| | 1* | 2* | 3 | 4 | 5* | 6 | 7 | 8 | 9 |
| Ca sulfonate, 400 TBN (incl 42% oil) | 15.4 | 16.4 | 12.4 | 8.3 | 13.9 | 12.2 | 10.3 | 10.6 | 11 |
| % TBN from Ca | 100 | 100 | 76.1 | 52.2 | 85.2 | 75.3 | 63.8 | 63.6 | 64.0 |
| Na sulfonate, 448 TBN (incl 31% oil) | | | 1 | 2 | 0.5 | 2 | 2 | 2 | 2 |
| % TBN from Na | 0 | 0 | 6.5 | 13.0 | 3.3 | 13.1 | 13.0 | 13.1 | 13.0 |
| Mg sulfonate, 400 TBN (incl 42% oil) | | | 3 | 6 | 2 | 2 | 4 | 4 | 4 |
| % TBN from Mg | 0 | 0 | 17.4 | 34.7 | 11.6 | 11.6 | 23.2 | 23.2 | 23.1 |
| % Phenol Substrate[a] | 54 | 31 | 30 | 29 | 30 | 30 | 31 | 17 | 0 |
| Succinimide dispersant (incl 40% oil) | 1 | 1 | 1 | 1 | 1 | 1 | 1 | 1 | 1 |
| p-Dodecylphenol | 0.47 | 0.19 | 0.19 | 0.19 | 0.19 | 0.19 | 0.19 | 0.09 | 0 |
| Test Results: | | | | | | | | | |
| Deposits, mg | 90.4 | 139.8 | 117.2 | 79.4 | 145.9 | 59.7 | 66.1 | 71.7 | 107.1 |
| Visual rating | 61 | 28 | 37 | 60 | 28 | 68 | 70 | 65 | 46 |

*A comparative example

[a]as % of total detergent substrates

The results show that when the amount of calcium alkylphenol sulfide is simply reduced from 5% to 2% (oil-containing basis), accompanied by an increase in the amount of calcium sulfonate (comparative examples 1 and 2), the amount of deposits produced significantly worsens. Addition of 1% or more sodium sulfonate (oil containing) along with magnesium sulfonate detergent significantly improves the level of deposit formation and/or the visual rating.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a cylinder of a marine diesel engine, comprising supplying to said cylinder a lubricant having a total base number (TBN) of at least about 25, which lubricant comprises an oil of lubricating viscosity and a metal-containing detergent component, which detergent component comprises a multiplicity of detergent species;

wherein about 55 to about 80 percent of the TBN derived from the metal-containing detergent component is provided by one or more calcium detergents; about 6 to about 15 percent of such TBN is provided by one or more sodium detergents; and about 10 to about 35 percent of such TBN is provided by one or more magnesium detergents;

wherein at least about 50 weight percent of the total detergent substrate in the lubricant is sulfonate detergent substrate and less than about 50 weight percent of the total detergent substrate in the lubricant is a monomeric or oligomeric substrate comprising one or more units of alkyl-substituted phenol which in turn comprises at least one alkyl group of about 8 to about 14 carbon atoms; and wherein said marine diesel engine is fueled with a liquid fuel which contains at least about 2 parts per million by weight vanadium.

2. The method of claim 1 wherein the alkyl-substituted phenol substrate is an alkylphenol sulfide substrate.

3. The method of claim 2 wherein the alkylphenol sulfide substrate is represented by the structure

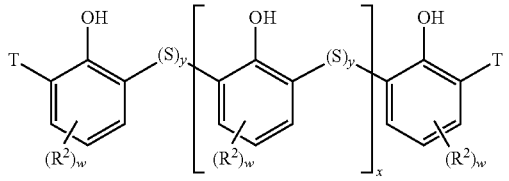

wherein each y is independently 1 to about 8; each $R^2$ is independently an alkyl group; each w is independently 0 to 3, provided that at least one aromatic ring contains an $R^2$ substituent containing about 8 to about 14 carbon atoms; each T is independently hydrogen or an $(S)_y$ linkage terminating in hydrogen or a non-phenolic hydrocarbyl group; and x is 0 to about 10.

4. The method of claim 1 wherein the alkyl-substituted phenol-containing substrate comprises about 1 to about 45 percent by weight of the total detergent substrate in the lubricant.

5. The method of claim 1 wherein the sulfonate detergent substrate is represented by $R^2$-T-$(SO_3H)_a$, wherein T is a cyclic nucleus; $R^2$ is an aliphatic group; $(R^2)$+T contains a total of at least 15 carbon atoms, and a is at least 1.

6. The composition of claim 1 wherein weight ratio of Mg to Na in the lubricant is about 0.5:1 to about 2:1.

7. The method of claim 1 wherein the lubricant comprises about 4.6 to about 8.1 weight percent of an overbased calcium sulfonate detergent and less than about 2.2 weight percent of a detergent having a monomeric or oligomeric substrate comprising one or more units of the alkyl-substituted phenol which in turn comprises at least one alkyl group of about 8 to about 14 carbon atoms.

8. The method of claim 1 wherein the lubricant comprises about 0.3 to about 1.4 weight percent of an overbased sodium sulfonate detergent; and about 1.1 to about 3.5 weight percent of an overbased magnesium sulfonate detergent.

9. The method of claim 1 wherein the lubricant comprises about 1 to about 2 percent by weight calcium alkylphenate detergent, about 4 to about 10 percent by weight calcium sulfonate detergent, about 1 to about 2 percent by weight sodium sulfonate detergent, and about 1.5 to about 3 percent by weight magnesium sulfonate detergent.

10. A marine diesel engine, fueled with a liquid fuel which contains at least about 2 parts per million by weight vanadium, having a cylinder thereof lubricated with a lubricant having a total base number (TBN) of at least about 25, which lubricant comprises an oil of lubricating viscosity and a metal-containing detergent component, which detergent component comprises a multiplicity of detergent species;

wherein about 55 to about 80 percent of the TBN derived from the metal-containing detergent component is provided by one or more calcium detergents; about 6 to about 15 percent of such TBN is provided by one or more sodium detergents; and about 10 to about 35 percent of such TBN is provided by one or more magnesium detergents; and wherein at least about 50 weight percent of the total detergent substrate in the lubricant is sulfonate detergent substrate and less than about 50 weight percent of the total detergent substrate in the lubricant a monomeric or oligomeric substrate comprising one or more units of alkyl-substituted phenol which in turn comprises at least one alkyl group of about 8 to about 14 carbon atoms.

11. A lubricant suitable for lubricating a cylinder of a marine diesel engine, comprising an oil of lubricating viscosity and a metal-containing detergent component, which detergent component comprises a multiplicity of detergent species, said lubricant having a total base number (TBN) of at least about 10;

wherein about 55 to about 80 percent of the TBN derived from the metal-containing detergent component is provided by one or more calcium detergents; about 6 to about 15 percent of such TBN is provided by one or more sodium detergents; and about 10 to about 35 percent of such TBN is provided by one or more magnesium detergents; and wherein at least about 50 weight percent of the total detergent substrate in the lubricant is sulfonate detergent substrate and less than about 50 weight percent of the total detergent substrate in the lubricant is a monomeric or oligomeric substrate comprising one or more units of alkyl-substituted phenol which in turn comprises at least one alkyl group of about 8 to about 14 carbon atoms.

12. The lubricant of claim 11 wherein the lubricant has a total base number of at least about 25.

13. The lubricant of claim 11 wherein the lubricant further comprises vanadium as a result of interaction with a vanadium-containing fuel within an engine.

* * * * *